US006174075B1

(12) United States Patent
Fuwausa

(10) Patent No.: US 6,174,075 B1
(45) Date of Patent: Jan. 16, 2001

(54) ILLUMINATED ORNAMENTATION/ AMUSEMENT DEVICE

(75) Inventor: Michelle Jillian Fuwausa, Columbia, MD (US)

(73) Assignee: Luminary Logic LTD, Columbia, MD (US)

( * ) Notice: Under 35 U.S.C. 154(b), the term of this patent shall be extended for 0 days.

(21) Appl. No.: 09/181,267

(22) Filed: Oct. 28, 1998

(51) Int. Cl.[7] ..... F21V 7/00

(52) U.S. Cl. ..... 362/310; 362/311; 362/327; 362/103; 362/104; 362/106; 362/278

(58) Field of Search ..... 362/310, 311, 362/103, 104, 327, 278, 106

(56) References Cited

U.S. PATENT DOCUMENTS

| | | | | |
|---|---|---|---|---|
| 4,009,381 | | 2/1977 | Schreiber et al. | 240/1 EL |
| 5,018,053 | | 5/1991 | Belknap et al. | 362/104 |
| 5,147,129 | * | 9/1992 | Ku | 362/106 |
| 5,253,149 | | 10/1993 | Ostema et al. | 362/104 |
| 5,813,148 | * | 9/1998 | Guerra | 36/137 |
| 6,007,211 | * | 12/1999 | Cheung | 362/103 |

* cited by examiner

*Primary Examiner*—Mohammad Y. Sikder
(74) *Attorney, Agent, or Firm*—Gottlieb Rackman & Reisman PC

(57) ABSTRACT

The customized clear, free from impediment, obstruction, or hindrance, or the translucent or transparent transmission of light is permitted to shine through an injected or poured pliable plastic which could be PVC, formulated to emit the maximum even dispersion of LED (light emitting diodes), illumination. The single or multiple LEDs are fitted into a cavity usually in the back of the plastic unit in order for the emission of light to pass through the unit. This light emitting unit is usually molded for application onto wearable apparel, accessories or decorative items and can be molded into varying shapes, colors, designs or logos with impressions within or on the surface in flat, two dimensional or three dimensional properties for illumination and exploitation of said unit. With the LEDs fitted or inserted into said unit and connected to a power source the said unit will emit light throughout the light transmitting device evenly and uniformly, thus attracting attention specifically to the illuminated image, logo or item rather than lighting for illuminations sake.

17 Claims, 6 Drawing Sheets

U
R
9
10
11
12
13
14
15
16
16A
17
18
19

12
14
16
17
18
19
20
20a
21
22
23
24
25
28
29
30
C
H

ILLUMINATED ORNAMENTATION/ AMUSEMENT DEVICE

BACKGROUND OF THE INVENTION

This invention relates to improvements in wearable illuminated ornamentation or amusement devices. More particularly, the invention pertains to an article which may be incorporated or other affixed or secured onto wearable apparel, accessories, decorative items, toys or games, including for instance hats, jackets, shirts, backpacks or shoes.

Illuminated decorative objects have been known for sometime which provide illumination of the LED through a battery source. Examples include U.S. Pat. Nos. 5,018,053, 5,253,149 and 4,009,381. These patents use a lighting source such as an LED powered by a battery and connected onto attachable clips, posts or the jewelry itself and are intolerant to impact, modification or flexibility of the items. The purpose of the LED's is to project light, and hence to illuminate another object.

In other prior illuminating devices, lighting of object is performed using fiber optics to obtain a back lighting which is relatively low in intensity when used for flat image or surface viewing. The optical fiber is usually not positioned directly under or integrated within the item to be illuminated making previous patents less efficient, vulnerable to separation, impact or flexibility. Thus, although such prior devices are known to serve their purposes, they have proven to be neither satisfactory nor do they reach maximum exploitation of uniform light illumination.

Thus, a need thus exists for an even more improved flexible, thin-format, light transmissive device which will insure even distribution of brightness while providing maximum illumination for logos, images or items within or on the surface of said item.

SUMMARY OF THE INVENTION

A light source, such as an LED (light emitting diode), is inserted into a cavity accessible from the back of a clear or translucent light transmitting pliable molded unit, which could be PVC, and could have a logo, image or other graphic element imbedded within or disposed on the surface of said unit. The unit is preferably molded into a three dimensional or planar configuration designed and constructed so as to allow the light to scatter evenly through the unit and illuminate graphic element. The light source is connected to an energy supply, which is typically a battery, through a switching mechanism. The switching mechanism may be either simple on/off switch, or it may be an electronic timing circuit which can turn the source on or off cyclically at a predetermined or variable duty cycle and frequency. Alternatively, a motion-activated switch, or a switch operating randomly may be used as well.

BRIEF DESCRIPTION OF THE DRAWINGS

Preferred embodiments of the present invention are illustrated in and by the following drawings in which like reference numerals indicate like parts and in which.

DETAILED DESCRIPTION OF THE INVENTION

Generally speaking, the present invention is directed to an lighted or illuminated ornamentation or amusement device comprising, a relatively thin, light-transmissive unit, a light source and a power source providing energy to the light source. A switching mechanism is also provided for selectively activating the light source. The unit is preferably flexible or pliable and is made of a plastic material such as PVC. The unit has a somewhat three dimensional or planar configuration and has a top surface on which there is formed customized image, a logo or other graphic elements. Alternatively the image may be imbedded into the unit. The unit is secured by sewing or other means to a wearable apparel, accessory, decorative item, a toy or a garment so on.

Figures 1, 2, 3, 4:
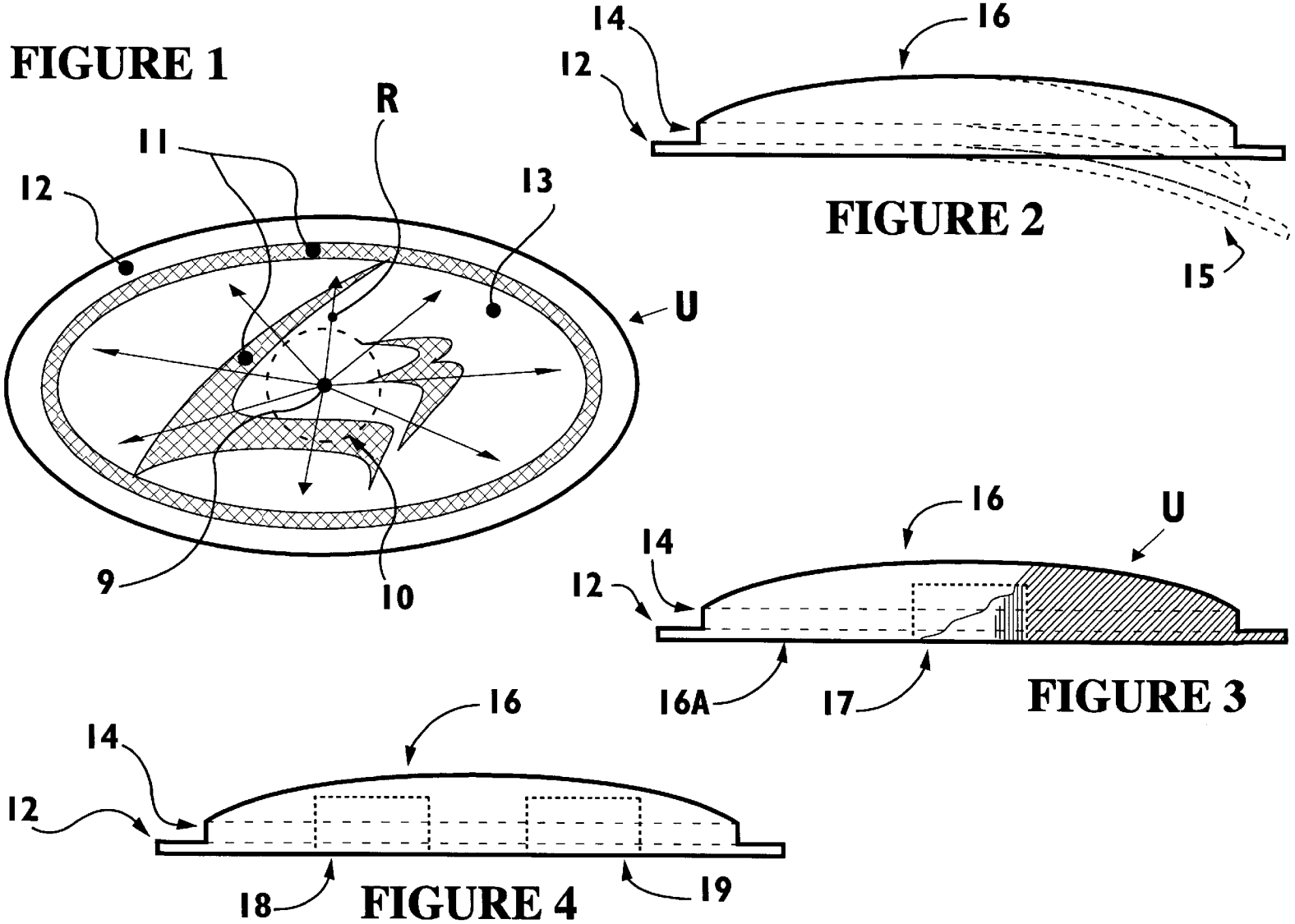
FIG. 1 is an exploded top view with a pliable plastic unit in accordance with the present invention.
FIG. 2 is a side elevational view of the unit of FIG. 1.
FIG. 3 is a partial side sectional view of the pliable unit of FIG. 1.
FIG. 4 is a side view of an alternate embodiment having two cavities.

More specifically, referring to FIGS. 1–3, a unit 13 is shown as having a generally circular, oval or ellipsoid shape with a top surface 16 and a bottom surface 16A. Of course, unit 13 may have any other shape as well. The unit 13 is made pliable so that it can be bent as illustrated by the dotted lines in FIG. 2. Top surface 16 includes one or more graphic elements 11 which form a predetermined design. The elements 11 may be painted onto surface 16 or maybe imbedded into the unit 13.

The unit 13 also has a circumferential lip 12 which may be used to secure the unit 13 to a garment or other article. The top surface 16 may be separated from the lip by a cylindrical side wall 14. The unit 13 is formed with a cavity 17 disposed at the center of the unit 13 and extending into the unit 13 from bottom surface 16A. Cavity 17 is structured to receive a light-source such as an LED 20 (shown in FIG. 5) which transmits light evenly through unit 13 as indicated in FIG. 1 by arrows R. More particularly the light from source 20 is transmitted uniformly around and through said unit 13 and highlighting the graphic elements 11. FIG. 4 shows that instead of a single LED receiving cavity, the unit 13 can be made with two or more cavities 18, 19, each receiving an appropriate light source.

Figures 5, 6, 7, 8:
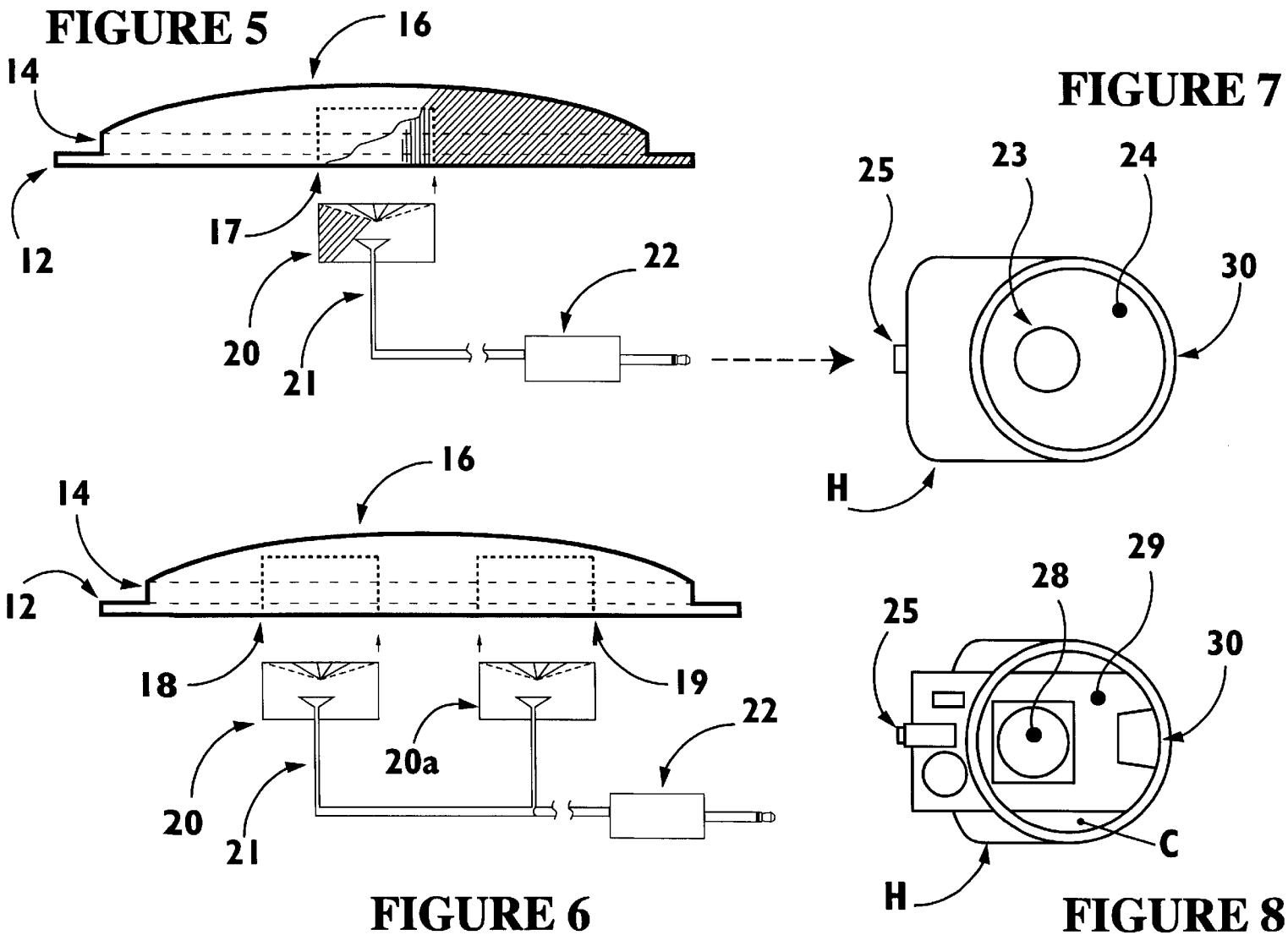
FIG. 5 is a side view of the unit of FIG. 1 showing the LED being inserted therein.
FIG. 6 is a side view of the unit of FIG. 2 with the LED being inserted therein.
FIG. 7 is a top external view of an electronic unit used to control the LEDs of FIG. 5 or 6.
FIG. 8 is a top view of the electronic unit of FIG. 7 with the top removed.

Referring now to FIG. 5, LED 20 is shaped and sized so that it can be inserted into cavity 17. A wire 21 connects LED 20 to a male plug 22.

There is also provided an electronic unit having a housing 30 with a female plug 25 for receiving male plug 22. Housing 30 also has a cover 24 with an activating switch 23. The switch 23 may be used to selectively activate LED 20 and as such, it may be an off/switch or a motion detector switch. Alternatively, as shown in FIG. 8 in which cover 14 has been removed, housing 30 may include a cavity C for a battery (not shown) and a PC board 29 with an electronic chip 28. Chip 28 may be activated by switch 23 to turn LED 20 on and off in a cyclical pattern. Alternatively, chip 28 may activate the LED in a random pattern.

FIG. 6 shows two LEDs 20, 20*a* inserted into cavities 18, 19 respectively and connected to the electronic unit by male plug 22.

Figure 9:
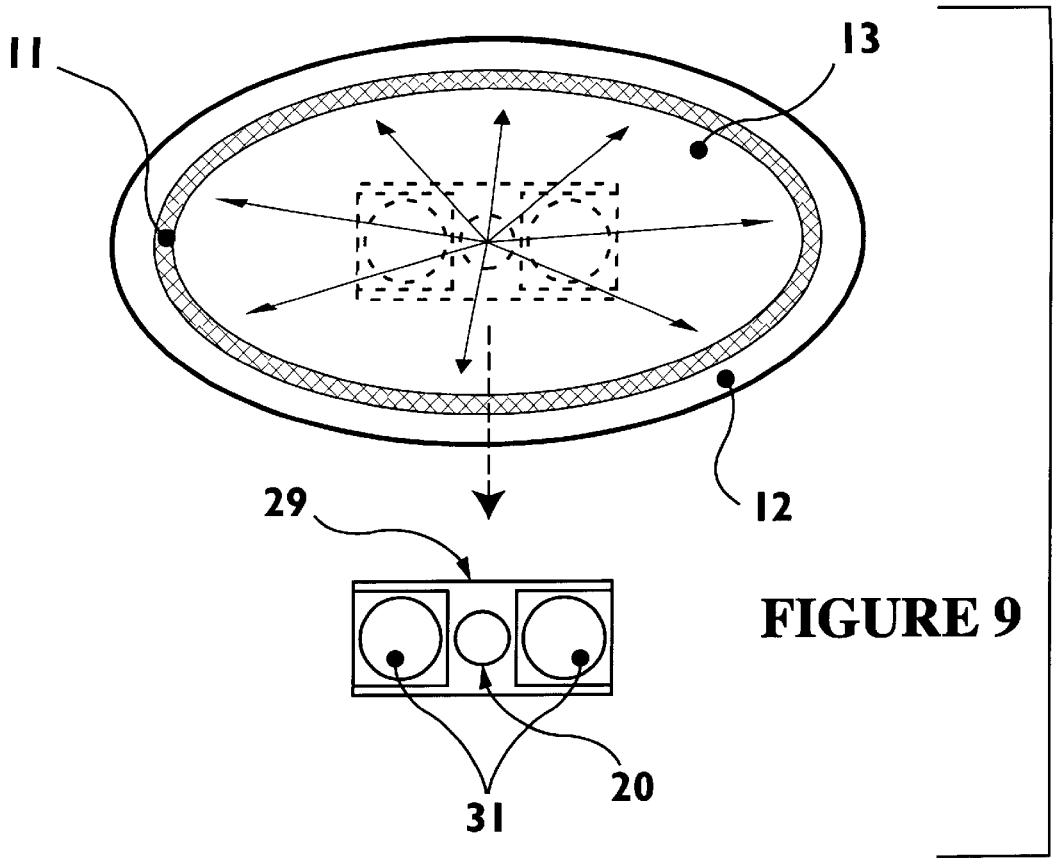
FIG. 9 is an exploded view of an alternate embodiment formed of an assembly of a translucent unit and a single unitary member including two LEDS and the electronic circuitry.
Figure 10:
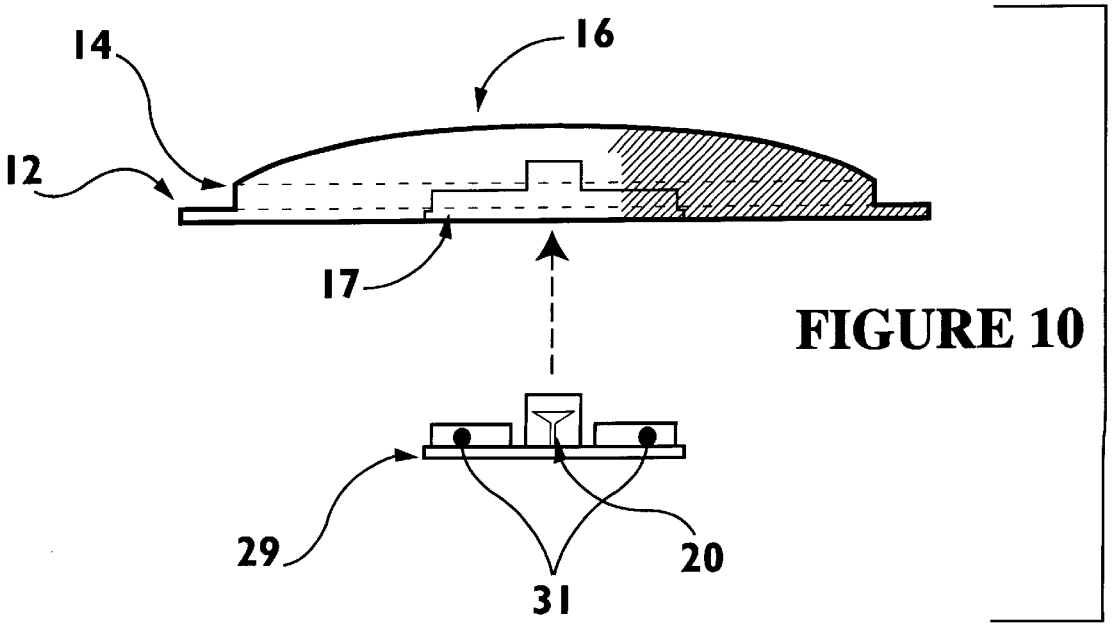
FIG. 10 is an exploded side view of the assembly of FIG. 9. a pliable unit with one cavity and a fully self contained electronic unit.

Of course, instead providing the LED and electronic unit as separate elements requiring a connecting wire and male and female connectors, a single housing 31 may be provided with the LED 20 extending outwardly. FIGS. 9 and 10 show a possible combination for this embodiment.

In these figures, unit 29 is provided not only with an LED 20, but also batteries 31. For this purpose, cavity 17 is enlarged so that unit 29 can fit within.

Figure 11:
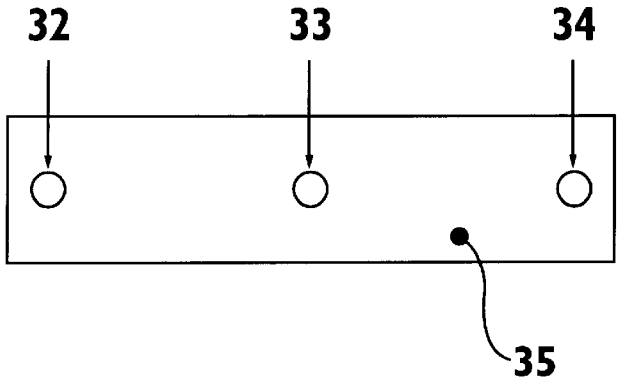
FIG. 11 is a top view of a first molding piece.
Figure 12:
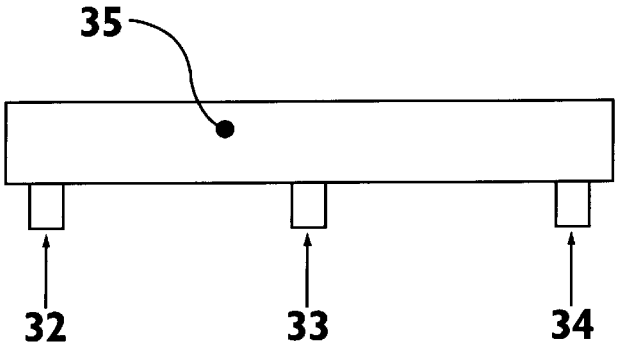
FIG. 12 is a side view of the molding piece of FIG. 11.

FIGS. 11 and 12 shows the top and side view respectively of a molding piece 35 usually generated by C.A.D., (computer aided design). The piece 35 could be cut out of brass or aluminum, or other similar materials.

The unit 35 has three specifically spaced circular pegs 32, 33, 34.

Figure 13:
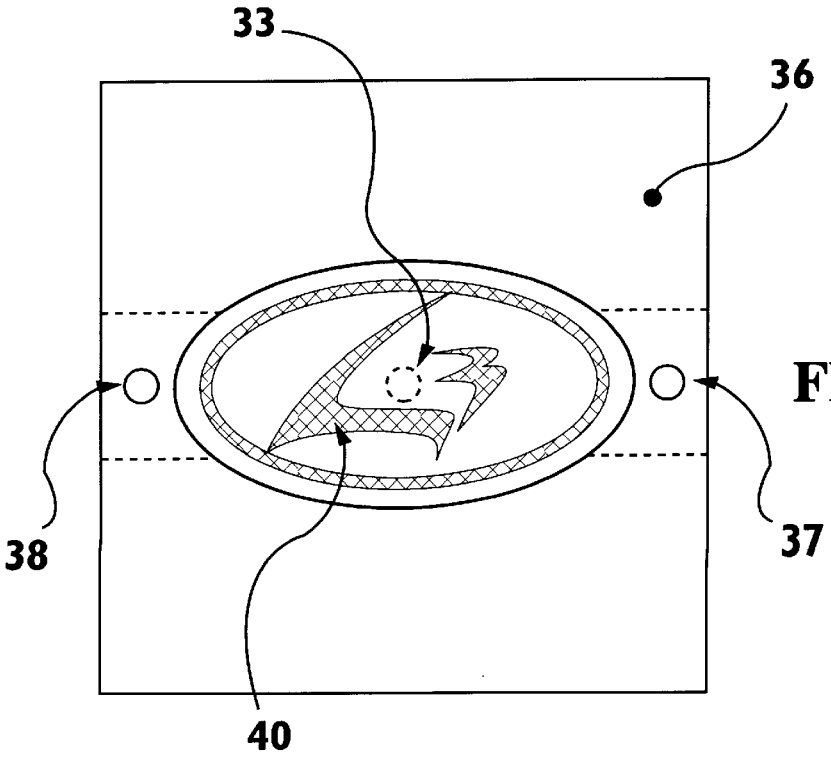
FIG. 13 is a top view of a second molding piece.
Figure 13A:
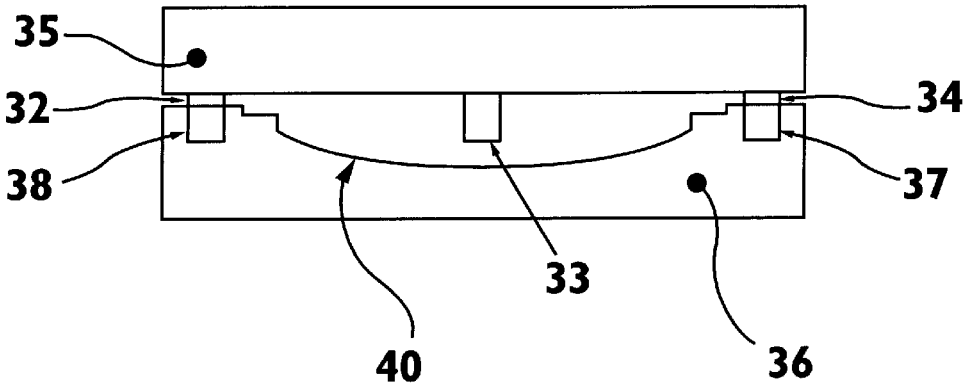
FIG. 13*a* shows a cross-sectional view of the molding pieces of FIGS. 11–13 assembled to form the plastic unit of FIGS. 1–4.
Figure 13B:
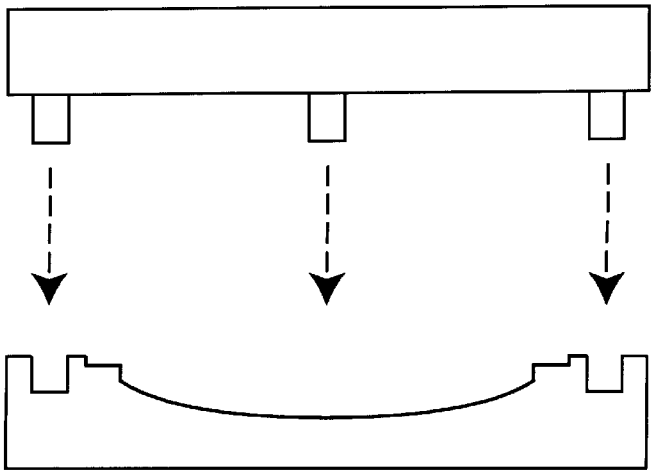
FIG. 13*b* shows the assembly of the two molding pieces of FIGS. 11–13.
Figure 14:
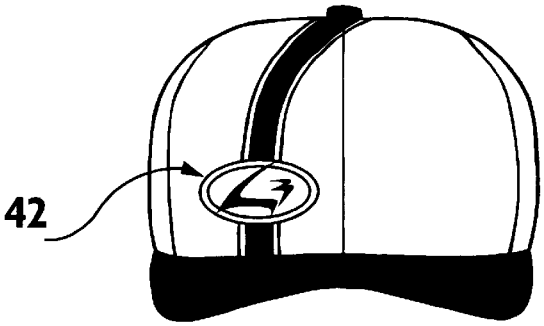
FIG. 14 is a front view of a hat having a pliable illuminated unit constructed in accordance with this invention.
Figure 15:
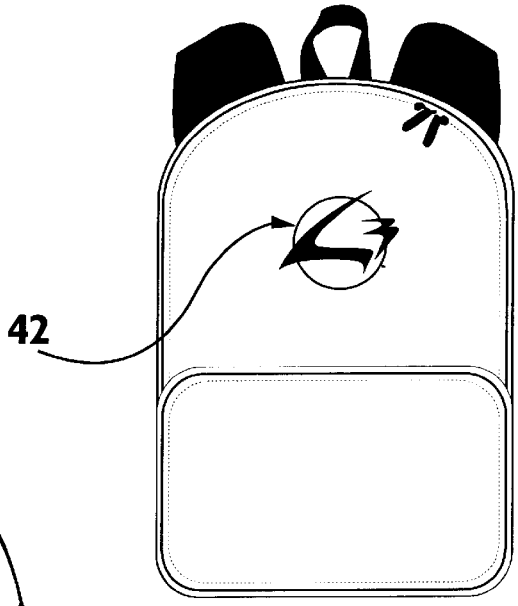
FIG. 15 is an elevational view of a backpack with an illuminated in accordance with this invention.
Figure 14A:
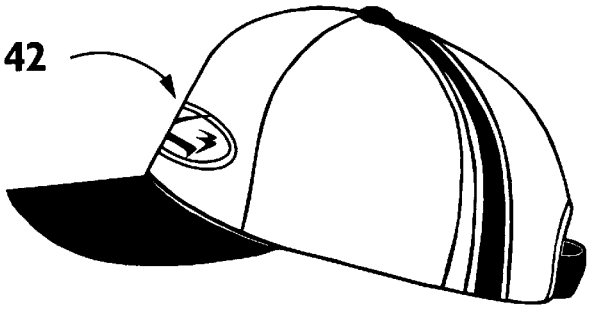
FIG. 14*a* is a side elevational view of the hat of FIG. 14.
Figure 16:
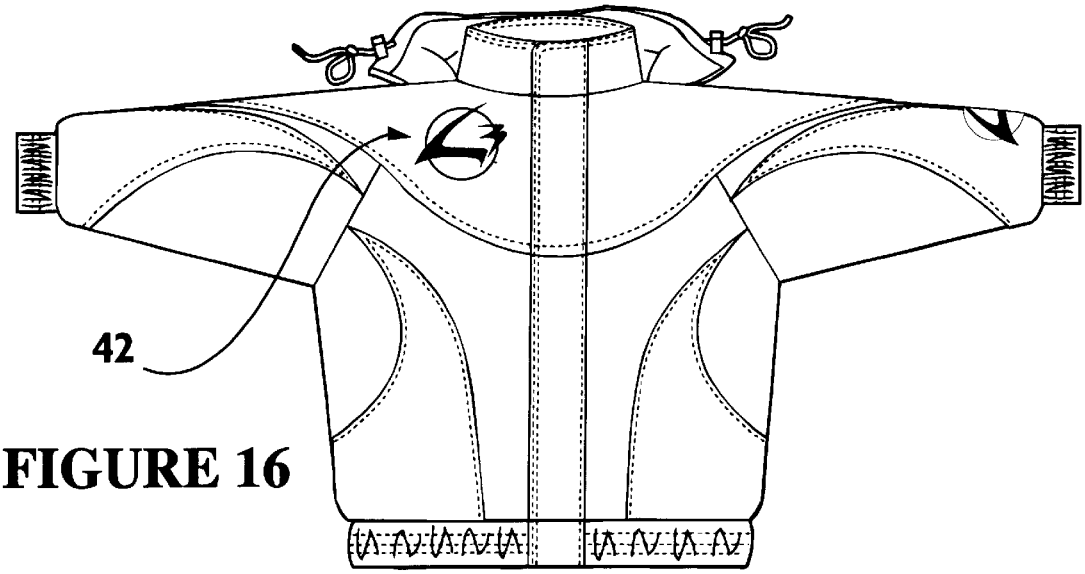
FIG. 16 is a front view of a jacket incorporating an illuminated unit in accordance with this invention.

The second molding piece 36 is generally flat and is formed on its top surface with two holes 37 and 38. In between these holes, a cavity 40 is formed in the size and shape of the plastic unit to be formed, such as, for instance, the plastic unit 13 of FIGS. 1–3. In order to make unit 13, molding piece 35 is placed over piece 36 and lowered (as seen in FIG. 13B) until pins 32 and 34 fit into holes 38 and 37 as best seen in FIG. 13*a*. Once the piece 35 is in place plastic material is poured into cavity 40 to generate unit 13.

The primary usage of the usually circular pegs 32, 34, are for joining and stabilizing both mold pieces 35, 36 insuring the specific placement, setup and quality of the intended poured images on unit 13, while circular peg 33, is specifically designated and designed to form the cavity 17 of the LED. Additional or different pegs may be used for forming cavities for electronic units or other items.

FIGS. 14, 14*a*, 15 and 16 show an assembly 42 attached to various types of articles such as a hat, a backpack or a jacket. In each case, the assembly 42 can be made of discrete parts as shown in FIGS. 5 and 7, or a single housing such as shown in FIGS. 9 and 10.

Obviously numerous modifications may be made to this invention without departing from its scope as defined in the appended claims.

I claim:

1. A decorative device comprising:

a unit having a top surface and a bottom surface, wherein a graphic image disposed on said top surface of said unit and visible on said top surface, said unit being made of one of a transparent and translucent material, a cavity disposed in said bottom surface and under said graphic image; and a light source disposed in said cavity along an axis normal to said top surface of the unit to direct light said top surface, wherein said graphical image being arranged to be illuminated by said light source.

2. The decorative device wherein said graphic image is formed on said top surface.

3. The decorative device of claim 1 wherein said light source is an LED.

4. The decorative device of claim 1 wherein said light source includes an LED, a power source and a switch for selectively activating said LED.

5. The decorative device of claim 1 further comprising a power source coupled to said light source.

6. The decorative device of claim 5 further comprising a switch for selectively activating said light source.

7. The decorative device of claim 6 further comprising a housing containing said switch and said power source.

8. The decorative device of claim 6 wherein said switch activates said light source in a cyclic pattern.

9. A decorative device comprising:

a unit made of a flexible transparent material, said unit bearing a graphic image and having a top surface and a bottom surface, wherein said graphic image disposed on said top surface and a cavity disposed in said bottom surface and under said graphic image of said top surface; and a light source disposed in said cavity along an axis normal to said top surface of the unit to direct light said top surface, wherein said light source arranged to emit light beams directed at said top surface to illuminate said graphic image.

10. The decorative device of claim 9 wherein said unit includes a circumferential rim for mounting said unit.

11. The decorative device of claim 9 wherein said light source includes an LED, a power source and a switch for activating said LED.

12. The decorative device of claim 11 wherein said light source includes a housing, said housing containing said LED, said power source and said switch.

13. The decorative device of claim 9 further comprising a separate housing including a power source for said light source.

14. The decorative device of claim 13 further comprising a switch for activating said light source.

15. The decorative device of claim 13 further comprising a switch for activating said light source, said switch being disposed in said separate housing.

16. A decorative device comprising:

a flat unit defined by a top and a bottom surface;

a graphic image positioned on said top surface and a cavity disposed in said bottom surface and under said graphic image of said top surface; and an LED embedded in said cavity of said bottom surface of said unit under said graphic image, said LED being positioned along an axis normal to said top surface of the unit to direct light said top surface and arranged to direct light to illuminate said graphic image.

17. The device of claim 16 further comprising a plurality of LED's, each being arranged to direct light along said axis.

* * * * *

US006174075C1

(12) EX PARTE REEXAMINATION CERTIFICATE (8620th)

United States Patent
Fuwausa

(10) Number: US 6,174,075 C1
(45) Certificate Issued: Oct. 11, 2011

(54) ILLUMINATED ORNAMENTATION/AMUSEMENT DEVICE

(75) Inventor: Michelle Jillian Fuwausa, Columbia, MD (US)

(73) Assignee: Ever Win International Corporation, City of Industry, CA (US)

Reexamination Request:
No. 90/011,008, Jul. 1, 2010

Reexamination Certificate for:

| | |
|---|---|
| Patent No.: | **6,174,075** |
| Issued: | **Jan. 16, 2001** |
| Appl. No.: | **09/181,267** |
| Filed: | **Oct. 28, 1998** |

(51) Int. Cl.

| | |
|---|---|
| ***A41D 27/08*** | (2006.01) |
| ***A41D 27/00*** | (2006.01) |
| ***G09F 13/22*** | (2006.01) |

(52) U.S. Cl. ..... 362/310; 362/104; 362/106; 362/278; 362/311; 362/327

(58) Field of Classification Search ..... None
See application file for complete search history.

(56) References Cited

U.S. PATENT DOCUMENTS

| | | | |
|---|---|---|---|
| 5,239,450 | A | 8/1993 | Wall |
| 5,653,524 | A | 8/1997 | Gray |
| 5,903,624 | A | 5/1999 | Boswell et al. |

*Primary Examiner*—Linh M. Nguyen

(57) ABSTRACT

The customized clear, free from impediment, obstruction, or hindrance, or the translucent or transparent transmission of light is permitted to shine through an injected of poured pliable plastic which could be PVC, formulated to emit the maximum even dispersion of LED (light emitting diodes), illumination. The single or multiple LEDs are fitted into a cavity usually in the back of the plastic unit in order for the emission of light to pass through the unit. This light emitting unit is usually molded for application onto wearable apparel, accessories or decorative items and can be molded into varying shapes, colors, designs or logos with impressions within or on the surface in flat, two dimensional or three dimensional properties for illumination and exploitation of said unit. With the LEDs fitted or inserted into said unit and connected to a power source the said unit will emit light throughout the light transmitting device evenly and uniformly, thus attracting attention specifically to the illuminated image, logo or item rather than lighting for illuminations sake.

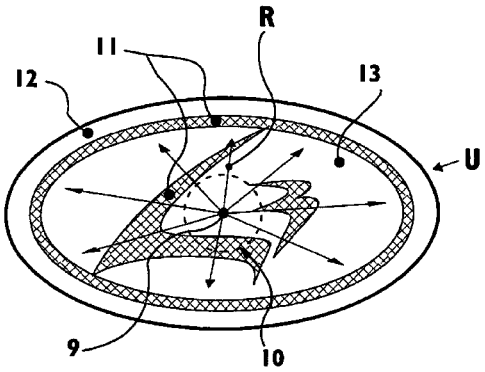

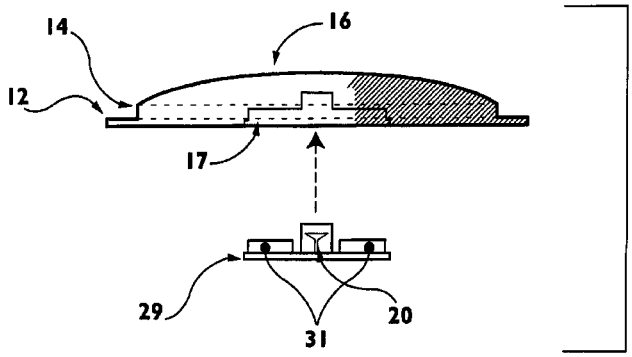

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 9 and 16 are determined to be patentable as amended.

Claims 2-8, 10-15 and 17, dependent on an amended claim, are determined to be patentable.

1. A decorative device comprising:

a unit having a top surface and a bottom surface, wherein a graphic image disposed on said top surface of said unit and visible on said top surface, said unit being made of one of a transparent and translucent material, a cavity *that takes up only partially of said bottom surface and* disposed in said bottom surface and under said graphic image; and a light source disposed in said cavity along an axis normal to said top surface of the unit to direct light said top surface, wherein said graphical image being arranged to be illuminated by said light source.

9. A decorative device comprising:

a unit made of a flexible transparent material, said unit bearing a graphic image and having a top surface and a bottom surface, wherein said graphic image disposed on said top surface and a cavity *that takes up only partially of said bottom surface and* disposed in said bottom surface and under said graphic image of said top surface; and a light source disposed in said cavity along an axis normal to said top surface of the unit to direct light said top surface, wherein said light source arranged to emit light beams directed at said top surface to illuminate said graphic image.

16. A decorative device comprising:

a flat unit defined by a top and a bottom surface;

a graphic image positioned on said top surface and a cavity *that takes up only partially of said bottom surface and* disposed in said bottom surface and under said graphic image of said top surface; and an LED embedded in said cavity of said bottom surface of said unit under said graphic image, said LED being positioned along an axis normal to said top surface of the unit to direct light said top surface and arranged to direct light to illuminate said graphic image.

* * * * *

US006174075C2

(12) EX PARTE REEXAMINATION CERTIFICATE (9957th)

United States Patent
Fuwausa

(10) Number: US 6,174,075 C2
(45) Certificate Issued: Nov. 22, 2013

(54) ILLUMINATED ORNAMENTATION/AMUSEMENT DEVICE

(75) Inventor: Michelle Jillian Fuwausa, Columbia, MD (US)

(73) Assignee: Ever Win International Corporation, City of Industry, CA (US)

Reexamination Request:
No. 90/012,279, May 3, 2012

Reexamination Certificate for:

| | |
|---|---|
| Patent No.: | **6,174,075** |
| Issued: | **Jan. 16, 2001** |
| Appl. No.: | **09/181,267** |
| Filed: | **Oct. 28, 1998** |

Reexamination Certificate C1 6,174,075 issued Oct. 11, 2011

(51) Int. Cl.

| | |
|---|---|
| ***A41D 27/00*** | (2006.01) |
| ***A41D 27/08*** | (2006.01) |
| ***G09F 13/22*** | (2006.01) |

(52) U.S. Cl.
USPC ..... 362/310; 362/103; 362/104; 362/106; 362/278; 362/311.02; 362/311.13; 362/327

(58) Field of Classification Search
None
See application file for complete search history.

(56) References Cited

To view the complete listing of prior art documents cited during the proceeding for Reexamination Control Number 90/012,279, please refer to the USPTO's public Patent Application Information Retrieval (PAIR) system under the Display References tab.

*Primary Examiner* — Hetul Patel

(57) ABSTRACT

The customized clear, free from impediment, obstruction, or hindrance, or the translucent or transparent transmission of light is permitted to shine through an injected or poured pliable plastic which could be PVC, formulated to emit the maximum even dispersion of LED (light emitting diodes), illumination. The single or multiple LEDs are fitted into a cavity usually in the back of the plastic unit in order for the emission of light to pass through the unit. This light emitting unit is usually molded for application onto wearable apparel, accessories or decorative items and can be molded into varying shapes, colors, designs or logos with impressions within or on the surface in flat, two dimensional or three dimensional properties for illumination and exploitation of said unit. With the LEDs fitted or inserted into said unit and connected to a power source the said unit will emit light throughout the light transmitting device evenly and uniformly, thus attracting attention specifically to the illuminated image, logo or item rather than lighting for illuminations sake.

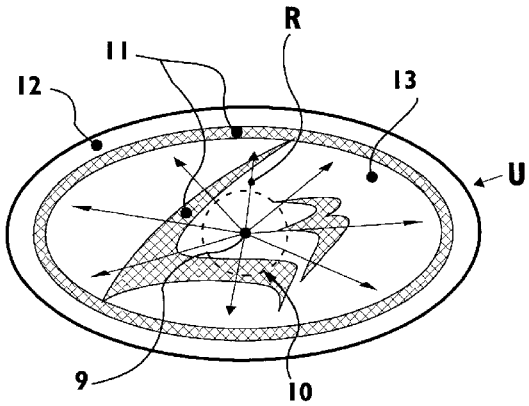

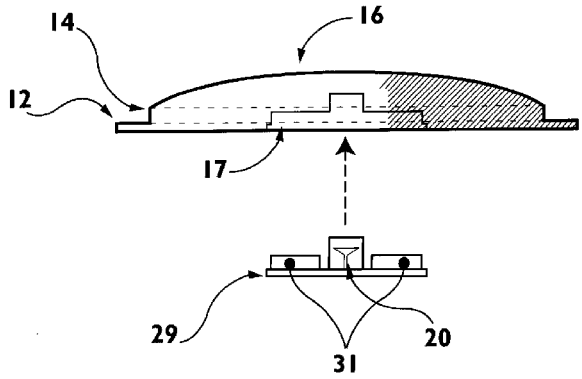

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-17 are cancelled.

* * * * *